US009579912B2

(12) United States Patent
Yokochi et al.

(10) Patent No.: US 9,579,912 B2
(45) **Date of Patent: *Feb. 28, 2017**

(54) DEVICE AND METHOD FOR ERASING AND COOLING A SHEET

(71) Applicants: KABUSHIKI KAISHA TOSHIBA, Tokyo (JP); TOSHIBA TEC KABUSHIKI KAISHA, Tokyo (JP)

(72) Inventors: Hidetoshi Yokochi, Shizuoka (JP); Hiroyuki Taki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,774

(22) Filed: Dec. 21, 2015

(65) Prior Publication Data

US 2016/0107466 A1 Apr. 21, 2016

Related U.S. Application Data

(62) Division of application No. 14/188,781, filed on Feb. 25, 2014, now Pat. No. 9,266,347.

(30) Foreign Application Priority Data

Feb. 26, 2013 (JP) ..... 2013-036178

(51) Int. Cl.

| | |
|---|---|
| ***B41J 29/377*** | (2006.01) |
| ***B41J 2/32*** | (2006.01) |
| ***B41M 7/00*** | (2006.01) |

(52) U.S. Cl.
CPC ..... *B41J 29/377* (2013.01); *B41J 2/32* (2013.01); *B41M 7/0009* (2013.01); *B41J 2202/37* (2013.01)

(58) Field of Classification Search
CPC ..... B41J 29/377; B41J 2/32; B41J 2202/37; B41M 7/00; B41M 7/009; B41M 7/0009
See application file for complete search history.

(56) References Cited

U.S. PATENT DOCUMENTS

| | | | | |
|---|---|---|---|---|
| 9,266,347 | B2 * | 2/2016 | Yokochi | B41J 29/377 |
| 2010/0181717 | A1 | 7/2010 | Sumikura | |
| 2010/0194839 | A1 | 8/2010 | Taguchi et al. | |

(Continued)

FOREIGN PATENT DOCUMENTS

| | | |
|---|---|---|
| EP | 1162518 | 11/1915 |
| JP | H08-30154 | 2/1996 |
| JP | H11-305615 | 11/1999 |

*Primary Examiner* — Kristal Feggins
(74) *Attorney, Agent, or Firm* — Patterson & Sheridan, LLP

(57) ABSTRACT

A device for cooling a sheet includes a conveyance path for the sheet between a first unit and a second unit. The conveyance path is formed of guide plates arranged in an opposed manner and through which the sheet is conveyed. A cooling unit cools the sheet which passes through the conveyance path, the cooling unit including at least one fan that supplies cooling air generally along a sheet conveying direction. At least one slit is formed in each of the guide plates. At least one introduction wall extends from one of the guide plates and guides cooling air from the at least one fan through the at least one slit and into the conveyance path.

20 Claims, 9 Drawing Sheets

(56) References Cited

U.S. PATENT DOCUMENTS

| | | | |
|---|---|---|---|
| 2010/0272449 | A1 | 10/2010 | Yoshida et al. |
| 2011/0222130 | A1 | 9/2011 | Iguchi et al. |
| 2012/0306985 | A1 | 12/2012 | Iguchi et al. |

* cited by examiner

DEVICE AND METHOD FOR ERASING AND COOLING A SHEET

CROSS-REFERENCE TO RELATED APPLICATION

This application is a division of U.S. patent application Ser. No. 14/188,781, filed Feb. 25, 2014, which is based upon and claims the benefit of priority from Japanese Patent Application No. 2013-036178, filed Feb. 26, 2013, the entire contents of each of which are incorporated herein by reference.

FIELD

Embodiments described herein relate generally to a device and method for erasing and cooling a sheet on which an image is formed by an image forming apparatus.

BACKGROUND

Conventionally, an image forming apparatus such as a Multi Function Peripheral (MFP) is used to form an image on a sheet (paper). For enabling the reuse of the sheet by erasing an image formed on the sheet, there exists a technique where an image is printed on the sheet using a coloring agent having a decoloring property such as ink containing a leuco dye.

A coloring agent having decoloring property is erased when the coloring agent is subjected to a high temperature. Accordingly, to reuse a sheet, the sheet is heated using an erasing device, thus erasing an image formed on the sheet. The erasing of an image formed on a sheet may also referred to as "decoloring" in the explanation made hereinafter.

In the erasing device, a platen roller and a heat source are arranged in an opposed manner with a sheet conveyance path interposed between the platen roller and the heat source. The sheet is heated by conveying the sheet between the platen roller and the heat source, thus erasing a coloring agent having decoloring property. A cooling fan for cooling the device is mounted downstream of the platen roller and the heat source. Accordingly, the sheet which is conveyed through a conveyance guide is cooled by air from the cooling fan.

However, the conventional device has a drawback that the sheet may not be efficiently cooled. A device for erasing an image on a sheet may also have a scanner for converting a printed content into electronic data before the sheet is decolored or for sorting a sheet on which a residual image is present after decoloring. However, when a temperature of the sheet is high at the time of conveying a sheet again to the scanner for sorting the remaining image after the sheet is decolored, toner on the sheet adheres to a glass surface of the scanner thus giving rise to a drawback that the quality of a scanned image is deteriorated.

DETAILED DESCRIPTION

According to an embodiment, a device for erasing an image on a sheet which may efficiently cool the sheet after decoloring.

A device for erasing an image on a sheet according to an embodiment includes a reading unit that reads an image formed on the sheet. An erasing unit erases the image formed on the sheet by heating the sheet. A conveyance path for the sheet between the reading unit and the erasing unit is formed of guide plates arranged in an opposed manner. A cooling unit cools the sheet which passes through the conveyance path and includes at least one fan that supplies cooling air generally along a sheet conveying direction. A plurality of slits is formed in each of the guide plates such that cooling air from the at least one fan flows through the slits into the conveyance path.

Hereinafter, exemplary embodiments are explained with referring to drawings. In the respective drawings, identical parts are given the same symbols.

First Embodiment

Figure 1:
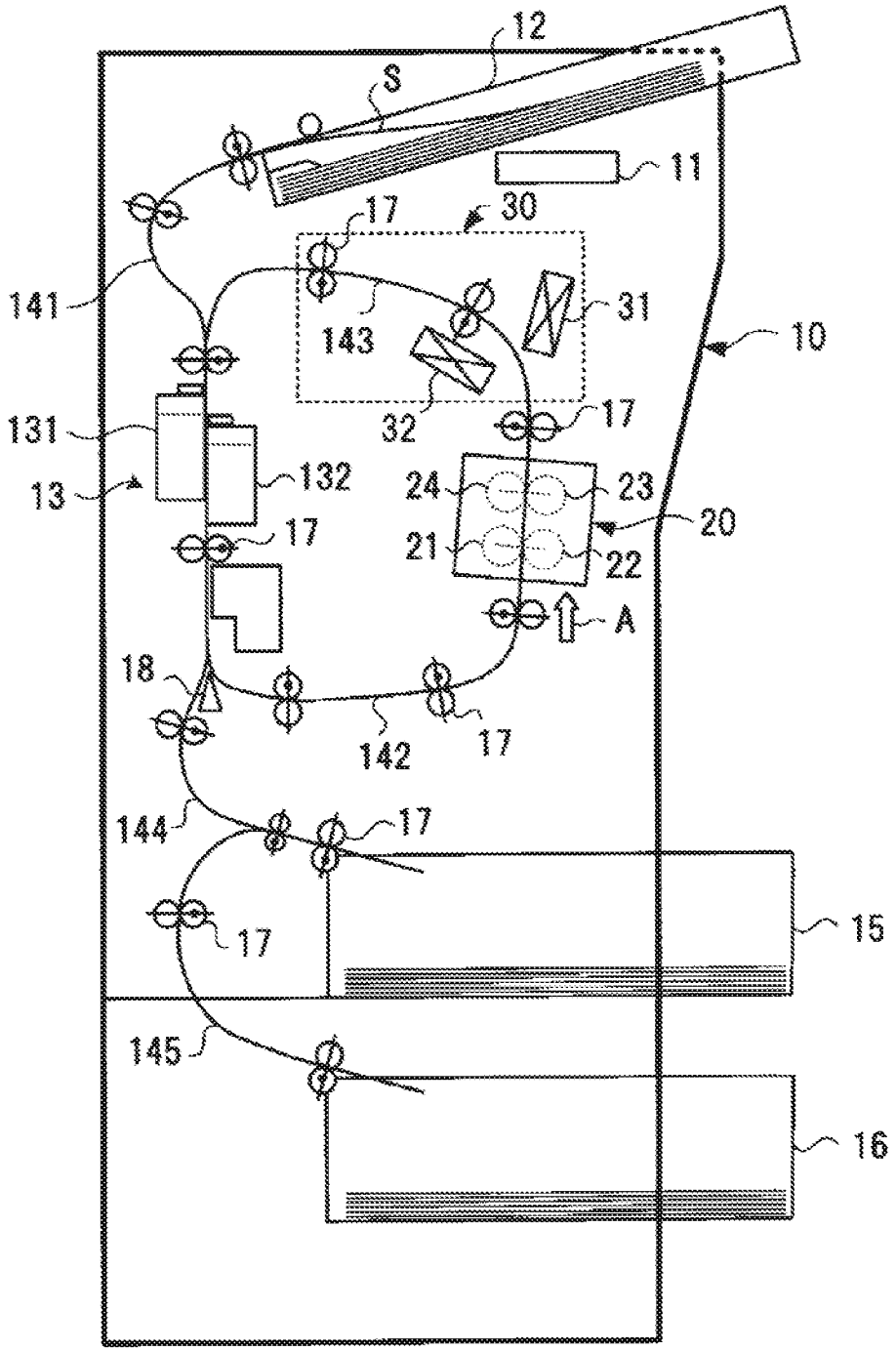
FIG. 1 illustrates a device for erasing an image on a sheet, according to a first embodiment.

FIG. 1 illustrates an erasing device 10 for erasing an image on a sheet according to the first embodiment. The erasing device 10 includes: an operation panel 11 having operation buttons and a display unit; a sheet feeding unit 12; a scanner 13 which constitutes a reading unit; and an erasing unit 20. The erasing device 10 also includes: a first conveyance path 141, a second conveyance path 142, a third conveyance path 143, a fourth conveyance path 144, a fifth conveyance path 145, a first sheet discharge tray 15, and a second sheet discharge tray (reject box) 16.

The conveyance paths 141 to 145 include a plurality of conveyance rollers 17 for conveying sheets. The plurality of conveyance rollers 17 are each driven by motors, respectively. A gate 18 is provided for sorting the conveyance of sheets between the conveyance path 142 and the conveyance path 144, respectively.

The first conveyance path 141 conveys a sheet S to the scanner 13 from the sheet feeding unit 12. The second conveyance path 142 conveys the sheet S toward the erasing unit 20 from the scanner 13 in the direction indicated by an arrow A. The third conveyance path 143 conveys the sheet S to the scanner 13 again from the erasing unit 20. The fourth conveyance path 144 conveys the sheet S to the first sheet discharge tray 15 from the scanner 13. The fifth conveyance path 145 conveys the sheet S to the reject box 16 from the scanner 13. The first sheet discharge tray 15 collects reusable sheets, for example, after an image is subject to the decoloring process. The reject box 16 collects sheets which are not reusable and are to be discarded/recycled.

The erasing device 10 shown in FIG. 1 performs the following operations (1) to (5) described below.

(1) A sheet S which is fed from the sheet feeding unit 12 through the first conveyance path 141 is read by the scanner 13. The scanner 13 includes a first scanner 131 and a second scanner 132 so that the scanner 13 can read both surfaces of the sheet S. The scanner 13 reads image data before the image on the sheet S is decolored, for example. The erasing device 10 also acquires a printing state of the sheet S, based on, for example, an identification of breakage or wrinkles from the image data generated by the scanner 13.

(2) The erasing device 10 stores the image data read by the scanner 13 or the like. When it is detected that the sheet S has breakage or wrinkles determined from the image data read by the scanner 13, the sheet S is introduced into the fifth conveyance path 145 and is conveyed to the reject box 16. The sheet S having no breakages and wrinkles is conveyed to the erasing unit 20 through the second conveyance path 142.

(3) The sheet S conveyed to the erasing unit 20 is heated while passing through the erasing unit 20 and the image formed on the sheet S is decolored by heat. The erasing unit 20 decolors the image on the sheet S which is formed using a coloring agent having decoloring property by applying heat and pressure to the sheet S at a relatively high temperature of 180 to 200° C., for example.

(4) The sheet S which passes through the erasing unit 20 is conveyed to the scanner 13 again through the third conveyance path 143. The scanner 13 scans the surfaces of the sheet and generates image data again to determine a printing state again so as to confirm whether or not an image formed using a coloring agent having decoloring property is sufficiently decolored.

(5) The reused sheet S is conveyed to the first sheet discharge tray 15 through the fourth conveyance path 144. Based on a printing state determined from the image data generated by the scanner 13, when it is determined that the image formed using a coloring agent having non-decoloring property or an image formed by handwriting remains in an image region of the sheet S or the sheet S has breaking or wrinkles, the sheet S is conveyed to the reject box 16 through the fifth conveyance path 145.

The erasing unit 20 includes a first erasing unit having a heat roller 21 and a press roller 22, and a second erasing unit having a press roller 23 and a heat roller 24. In the erasing unit 20, the sheet S is conveyed to and between the heat roller 21 and the press roller 22 and between the press roller 23 and the heat roller 24, and the sheet S is heated. The heat rollers 21, 24 each respectively have a heat source therein and respectively have a temperature detection unit on an outer periphery thereof. A lamp may be used as the heat source, for example. The heat source of the first erasing unit has larger heat capacity than the heat source of the second erasing unit.

A cooling unit 30 includes cooling fans 31, 32. The cooling unit 30 lowers a temperature of the heated sheet S and is arranged along the conveyance path for the sheet S downstream of erasing unit 20. By powering the fans 31, 32, air flows in the conveyance path 143 for the sheet S.

Next, the arrangement of the cooling unit 30 is explained with referring to FIG. 2A to FIG. 4.

Figure 2A:
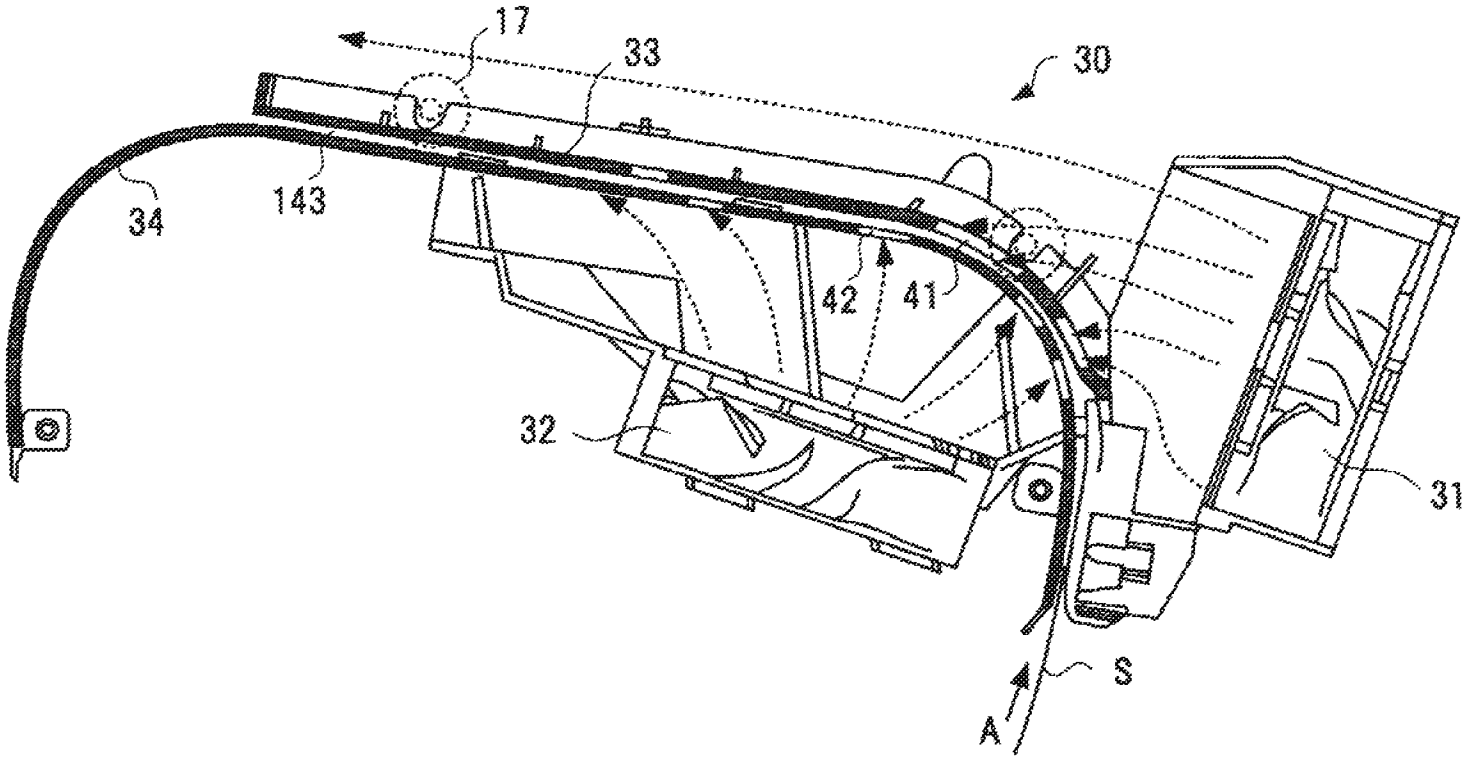
FIG. 2A is a cross-sectional view showing a cooling unit of the device, according to the first embodiment.

FIG. 2A is a cross-sectional view of the cooling unit 30. An upper guide plate 33 and the lower guide plate 34 are arranged to face each other in an opposed manner. A preset gap is between the upper guide plate 33 and the lower guide plate 34 for forming the conveyance path 143 for a sheet S. Hereinafter, the upper guide plate 33 is referred to as an upper guide 33, and the lower guide plate 34 is referred to as a lower guide 34.

For guiding a sheet S discharged from the erasing unit 20 to the scanner 13 (FIG. 1), the upper guide 33 and the lower guide 34 are curved in an arc toward the scanner 13 from the erasing unit 20 so that the sheet S is conveyed in the direction indicated by an arrow A while passing through between the upper guide 33 and the lower guide 34. The fan 31 is arranged outside a curved surface of the upper guide 33. When the fan 31 is powered, cooling air from the fan 31 flows toward a downstream side of the conveyance path from the curved surface of the upper guide 33. On the other hand, the fan 32 is arranged outside the curved surface of the lower guide 34. When the fan 32 is powered, cooling air from the fan 32 flows toward a downstream side of the conveyance path from the curved surface of the lower guide 34. That is, in the cooling unit 30, the first fan 31 and the second fan 32 are arranged on both sides of the third conveyance path 143 respectively with respect to the third conveyance path 143.

A plurality of slits 41 are formed in the upper guide 33 for allowing air from the fan 31 to flow into the conveyance path 143. Likewise, a plurality of slits 42 are formed in the lower guide 34 for allowing air from the fan 32 to flow into the conveyance path 143.

Figure 2B:
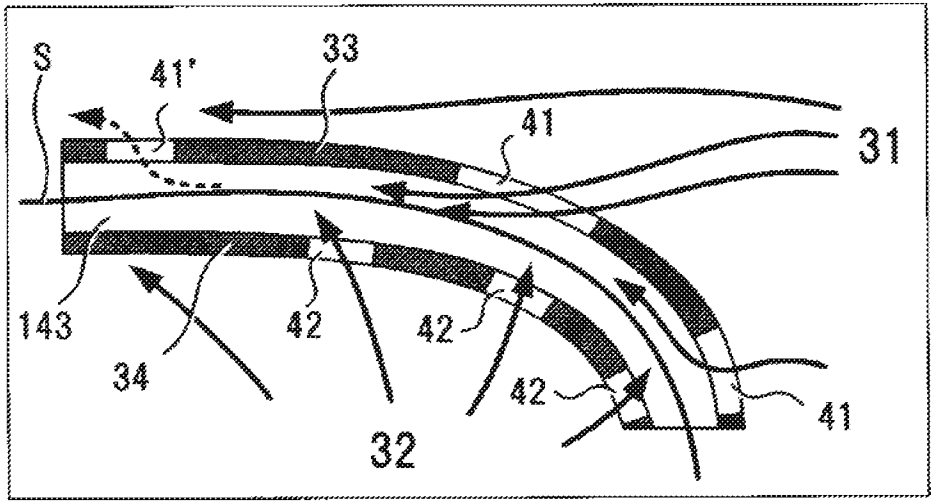
FIG. 2B is an enlarged cross-sectional view showing the cooling unit of the device.

FIG. 2B is an enlarged cross-sectional view showing a flowing state of air from the fans 31, 32 into the conveyance path 143 through the slits 41, 42. A bold arrow in FIG. 2B indicates the flow of air. Air from the fan 31 passes on an upper surface of the upper guide 33. The air from the fan 31 flows into the conveyance path 143 through the slits 41, and also flows toward a downstream side of the conveyance path 143. By forming slits 41' in a downstream-side portion of the upper guide 33, air in the conveyance path 143 which is heated by heat of the sheet S may be discharged to the outside through the slits 41'.

Air from the fan 32 passes on a lower surface of the lower guide 34. The air from the fan 32 also flows into the conveyance path 143 through the slits 42, and flows toward a downstream side of the conveyance path. The sheet S in the conveyance path 143 is cooled by air which flows into the conveyance path 143 from upper and lower sides through the slits 41, 42 and, thereafter, is conveyed to the scanner 13.

Figure 3:
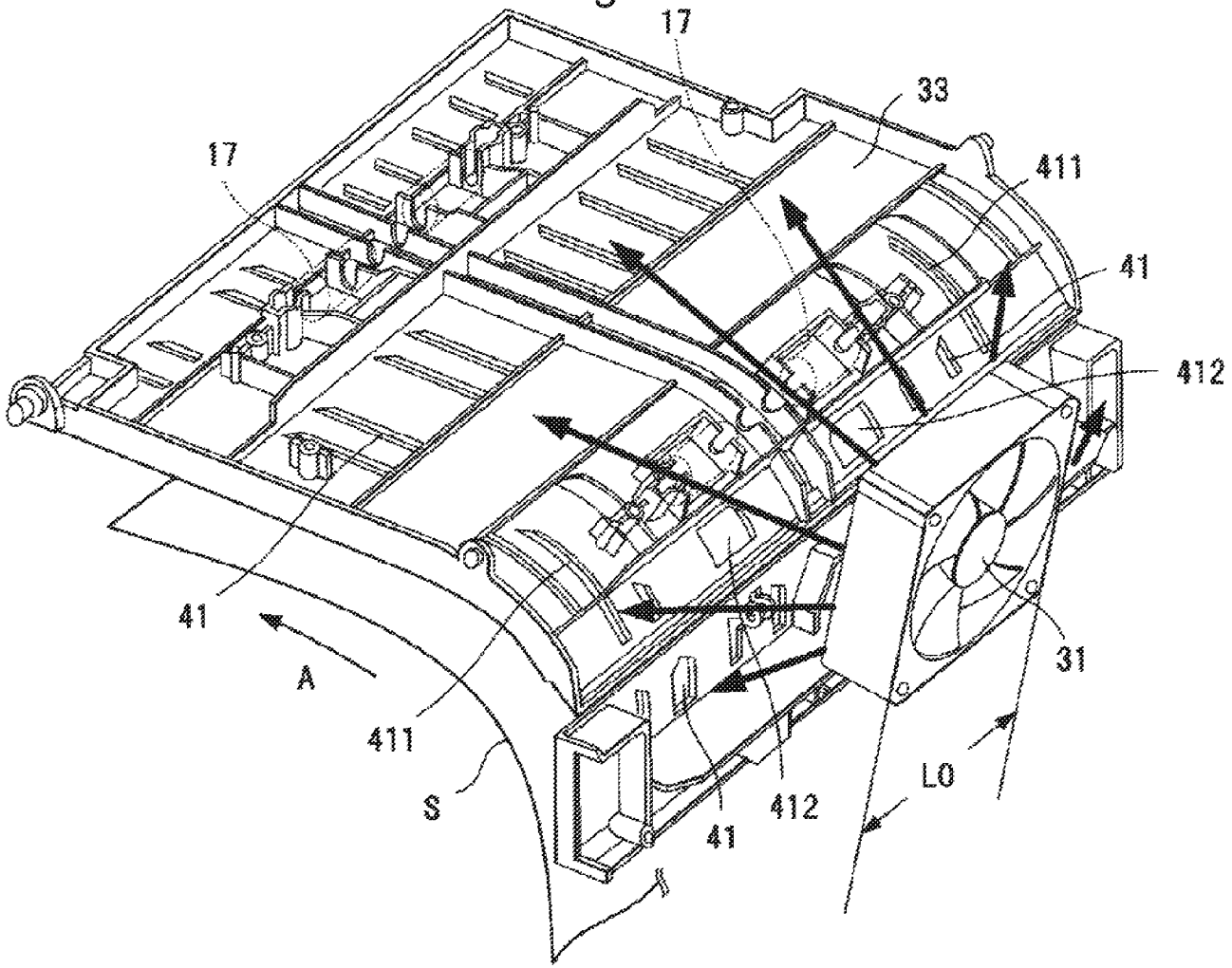
FIG. 3 is a perspective view showing an upper guide plate and a fan of a cooling unit, according to the first embodiment.
Figure 4:
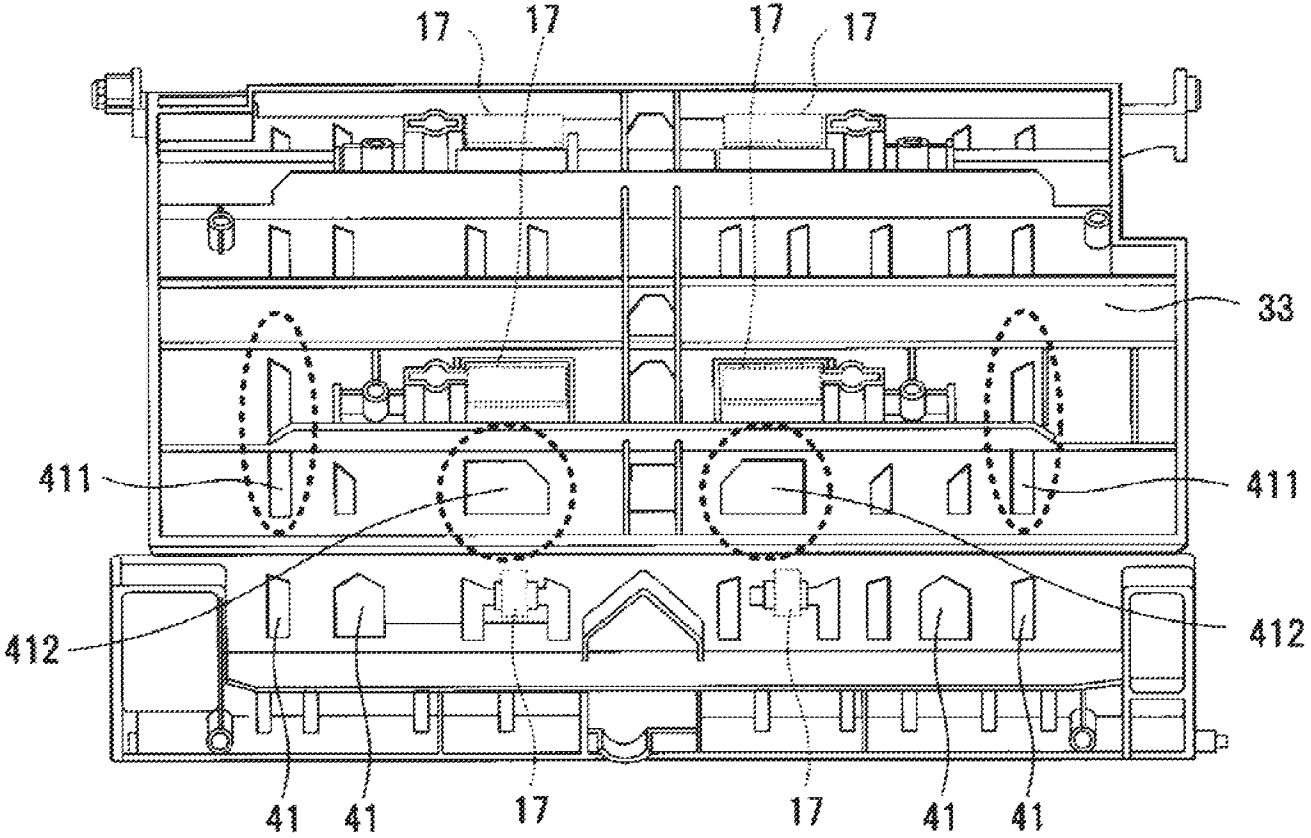
FIG. 4 is a plan view showing the upper guide plate.

FIG. 3 is a perspective view showing the upper guide 33 of the cooling unit 30 as viewed in the direction from the fan 31. FIG. 4 is a plan view of the upper guide 33, wherein the fan 31 is omitted. As shown in FIG. 3, the plurality of slits 41 are formed in the upper guide 33 for supplying air from the fan 31 into the conveyance path 143. The plurality of slits 41 are formed in an elongated manner along the conveyance direction A of a sheet S. The plurality of conveyance rollers 17 are mounted on the upper guide 33 along the conveyance path 143 for conveying a sheet S.

Air from the fan 31 flows toward the upper guide 33 in a radially spreading manner from the fan 31, as indicated by a bold arrow. Because of a characteristic of the fan 31, air from the fan 31 exhibits a higher flow speed on an outer portion compared to an inner portion, so that air from the fan 31 spreads radially. In other words, air which flows toward the upper guide 33 from the fan 31 does not flow uniformly.

The plurality of slits 41 are now described. Slits 411 are formed on a downstream side of peripheral portions of the upper guide 33 (regions within an elliptical circle indicated by a bold dotted line in FIG. 4) and are more elongated in the conveyance direction of the sheet S than other slits of the plurality of slits 41. Slits 412 are formed in a center portion of the upper guide 33 (a region within a circle indicated by a bold dotted line in FIG. 4) and are formed with a width larger than widths of other slits 41 in the lateral direction (i.e., in the direction orthogonal to the conveyance direction).

By forming the slits 411 into an elongated shape in the conveyance direction, it is possible to elongate a distance along which air which spreads in the directions toward the peripheral air flow of the fan 31. Also, the air from the fan that flows in the direction toward a downstream side may be taken into the conveyance path 143. Further, air which advances toward the upper guide 33 from a center portion of the fan 31 sufficiently flows into the conveyance path 143 due to the slits 412 having a large width and hence, air uniformly flows in the conveyance path 143. Accordingly, it is possible to efficiently cool the sheet S. Further, the air flows along an upper surface of the upper guide 33 and hence, the upper guide 33 may be also cooled.

Accordingly, in the first embodiment, heat is not accumulated in the conveyance path 143. Thus, the reading unit 13 is not influenced by heat of the sheet S thus preventing a reduction in the quality of a scanned image. The slits 42 formed in the lower guide 34 may be also formed such that the slits formed on a downstream side of peripheral portions of the lower guide 34 are formed in an elongated manner in the conveyance direction of the sheet S. Similarly, the slits formed on a center portion of the lower guide 34 have a large width in the lateral direction.

Second Embodiment

Figure 5A:
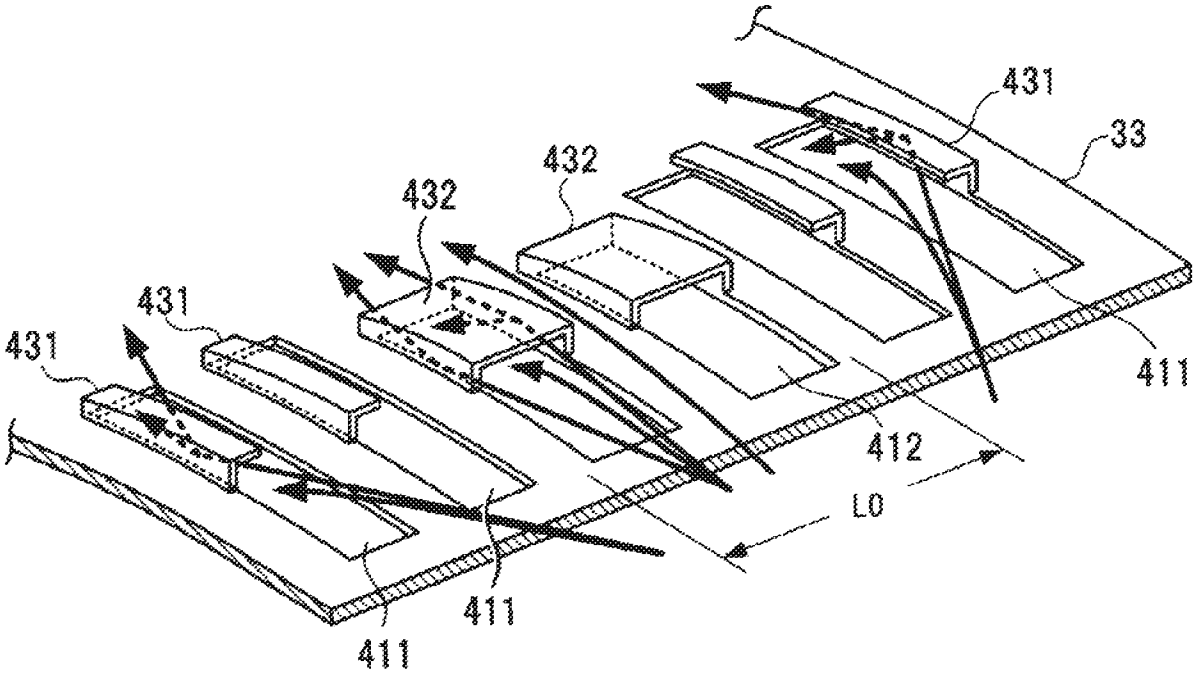
FIG. 5A is a perspective view showing an introducing wall of an upper guide plate of a device for erasing an image on a sheet according to a second embodiment.
Figure 5D:
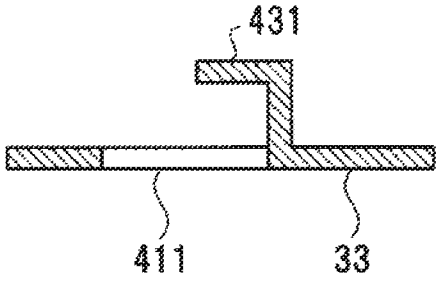
FIG. 5D is a cross-sectional view showing the introducing wall formed on a peripheral portion of the upper guide plate.
Figure 5C:
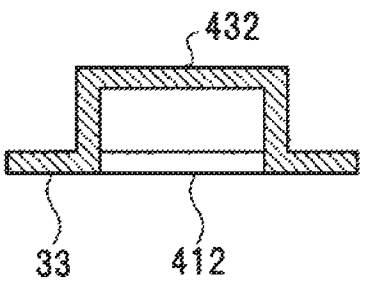
FIG. 5C is a cross-sectional view showing the introducing wall formed on a center portion of the upper guide plate.
Figure 5B:
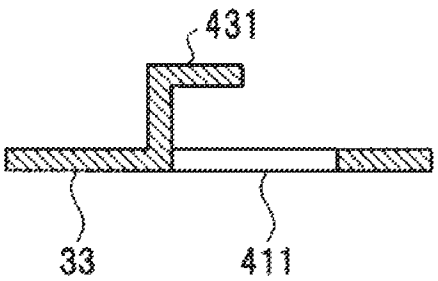
FIG. 5B is a cross-sectional view showing the introducing wall formed on a peripheral portion of the upper guide plate.

Next, an arrangement of the cooling unit 30 according to the second embodiment is explained. In the second embodiment, introducing walls are formed along the slits 41 formed in the upper guide 33. FIG. 5A is an enlarged, perspective view showing the slits 41 and the introducing walls 43 formed on the upper guide 33. FIG. 5B and FIG. 5D are cross-sectional views of introducing walls 431 formed on peripheral portions of the upper guide 33. FIG. 5C is a cross-sectional view of an introducing wall 432 formed on a center portion of the upper guide 33.

As described previously, because of a characteristic of the fan 31, air from the fan 31 exhibits a higher flow speed on an outer portion compared to an inner portion. The air from the fan 31 spreads radially, and flows toward a downstream side from an upstream side of the upper guide 33. To allow air to efficiently flow into a conveyance path 143, the plurality of slits 41 are formed in the upper guide 33 along the conveyance direction of a sheet S. Further, to allow air to flow into the conveyance path 143 from the slits 41, introducing walls 43 are formed on the slits 41 respectively. The term "introducing walls 43" generically refers to the introducing walls 431, 432.

The introducing walls 43 are formed along the longitudinal direction (conveyance direction of the sheet S) of the slits 41. As shown in FIG. 5A and FIG. 5B, with respect to the slits 411 formed on peripheral portions of the upper guide 33, the introducing wall 431 has an L shape in cross section and is raised from an outer edge (an edge on a side remote from the fan 31) of the slit 411 and extends toward an inner edge of the slit 411. As shown in FIG. 5C, with respect to the slits 412 which are formed in the center portion (position facing the fan 31 in an opposed manner) of the upper guide 33, a tunnel-type introducing wall 432 is formed such that an outer edge and an inner edge of the slit 412 are connected to each other.

As shown in FIG. 3, assuming a profile of the fan 31 as L0, the tunnel-type introducing wall 432 may be provided to the slits 412 arranged at the position corresponding to a width L0 of the center portion of the upper guide 33.

As indicated by a bold line in FIG. 5A, by providing the introducing walls 431 to the slits 411 formed in the peripheral portions, air from the fan 31 which spreads peripherally and flows in the direction toward a downstream side is divided into air which directly flows into the slits 411, air which flows into the slits 411 after being reflected on the introducing walls 431, and air which flows on the upper guide 33 toward the center portion after being reflected by the introducing walls 431.

As indicated by a bold line in FIG. 5A, by providing the introducing wall 432 on the slits 412 formed in the center portion, air from the fan 31 which flows in the direction toward a downstream side from the center portion of the fan 31 is divided into air which directly flows into the slits 412, air which flows into the slits 412 after being reflected on ceilings or side walls of the introducing walls 432, air which flows on the upper guide 33 after being reflected on the introducing walls 432, and air which flows on the upper guide 33 after passing through the inside of the introducing walls 432.

Accordingly, air which spreads from the peripheral portion of the fan 31 is introduced into the conveyance path 143 by the introducing walls 431, and air from the center portion of the fan 31 is introduced into the conveyance path 143 by the ceilings and side walls of the introducing walls 432. Thus, air flows in the conveyance path 143 uniformly, efficiently cooling the sheet S.

Although the explanation is made with respect to the example where the introducing wall 43 (431, 432) is provided to the slits 41 (411, 412) formed in the upper guide 33 with referring to FIGS. 5A to 5D, in the same manner in the slits 42 formed in the lower guide 34, an introducing wall may be also provided to the slit 42 of the lower guide 34 so as to bring air into the conveyance path 143.

Third Embodiment

An arrangement of the cooling unit 30 according to the third embodiment is explained. In the third embodiment, a fin 44 is mounted on upper portions of the slits 41 of the upper guide 33.

Figure 6A:
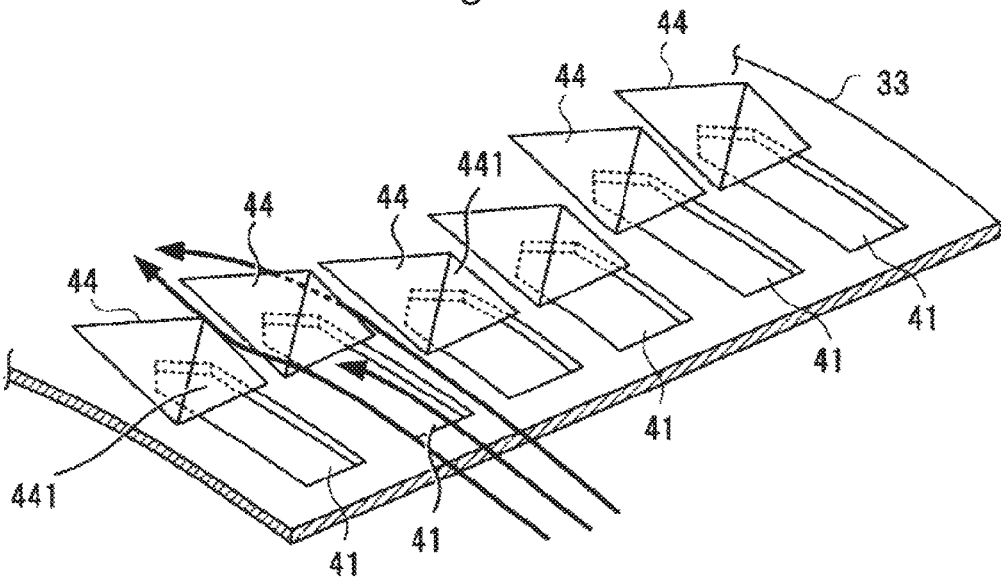
FIG. 6A is a perspective view showing fins of an upper guide plate of a device for erasing an image on a sheet according to a third embodiment.
Figure 6B:
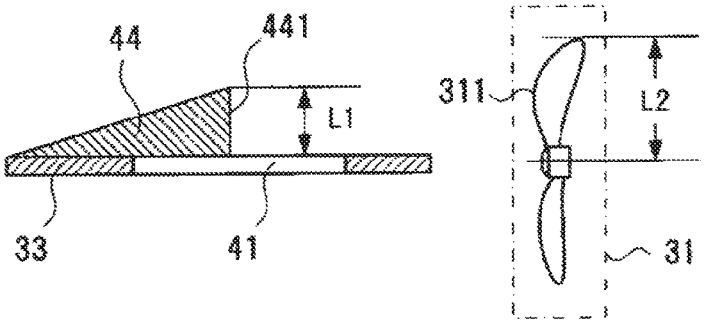
FIG. 6B is a cross-sectional view showing the fins of the upper guide plate.

FIG. 6A is an enlarged perspective view showing the fins 44 mounted on the upper portions of the slits 41 of the upper guide 33. FIG. 6B is a cross-sectional view of the fin 44 taken along the longitudinal direction of the slit 41, and FIG. 6C is a plan view of the upper guide 33 including the fins 44 as viewed from above.

The fin 44 has a triangular-shaped surface 441 on which air from the fan 31 hits or impinges, and has a triangular pyramid structure where a height and a width of the fin 44 is gradually decreased in the conveyance direction of a sheet S from the triangular-shaped surface 441. As shown in FIG. 6B, assuming a height of the triangular-shaped surface 441 of the fin 44 as L1 and assuming a length of one blade 311 of the fan 31 as L2, the relationship of L1<L2 is established. By establishing the relationship of L1<L2, even when air from the fan 31 hits the fin 44, some air may be made to flow toward an upper surface side of the upper guide 33 and some air is directed into the slit 41.

Figure 6C:
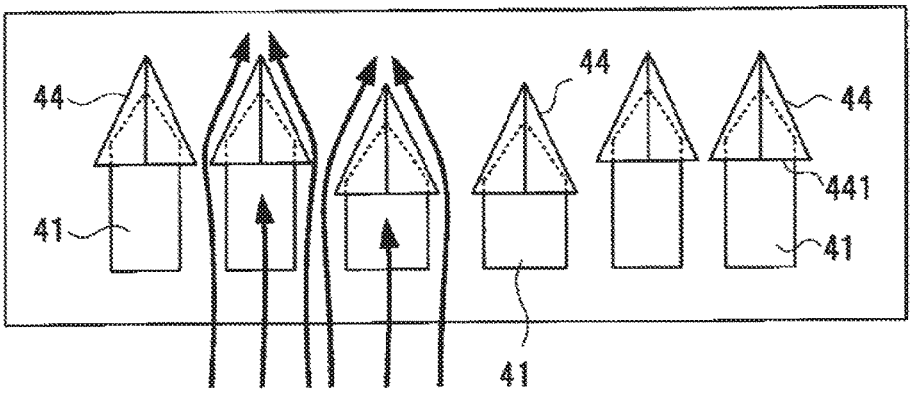
FIG. 6C is a plan view showing the fins of the upper guide plate.

As indicated by bold lines in FIG. 6A and FIG. 6C, by forming the fins 44 on the upper portions of the slits 41 respectively, air which flows in the direction toward a downstream side from the fan 31 is divided into air which directly flows into the slits 41, air which flows into the slits 41 after hitting the triangular-shaped surface 441, and air which flows on an upper surface of the upper guide 33 in the direction toward a downstream side while routing around side surfaces of the triangular pyramid shape of the fin 41.

Accordingly, air from the fan 31 may be made to efficiently flow into the conveyance path 143 and cool the sheet S. As described above, by setting the height L1 of the fin 44 lower than the length L2 of the blade 311 of the fan, air which does not flow into the conveyance path 143 may be made to flow along the upper surface of the upper guide 33, whereby the upper guide 33 may be also cooled. Further, by forming the fin 44 into a shape in which a width of the fin 44 is gradually narrowed toward a downstream side in the conveyance direction of the sheet S, noises generated when air hits the fin 44 may be decreased, thus making the erasing device quiet.

Figure 7A:
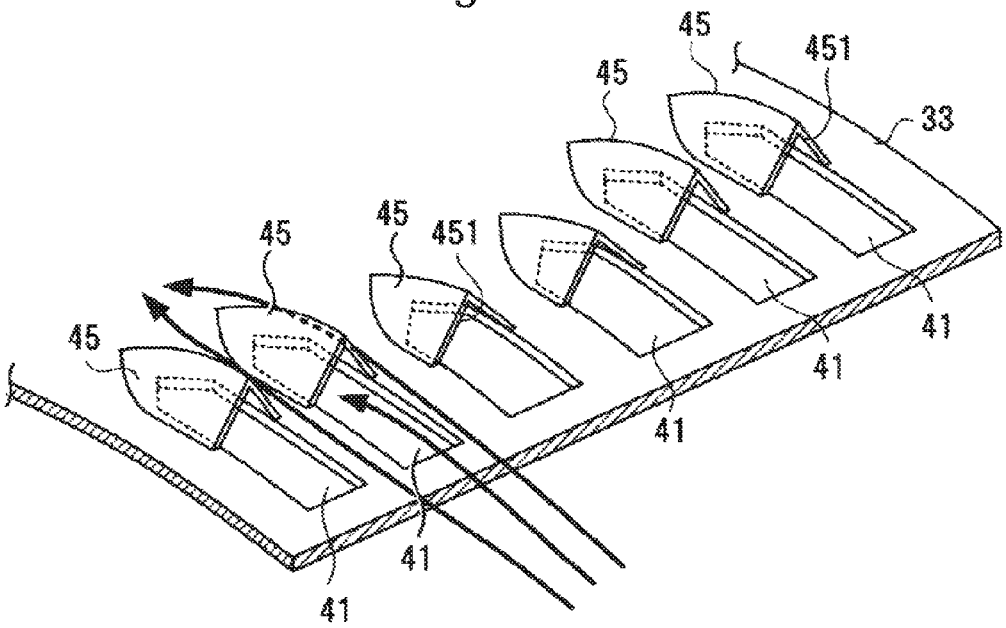
FIG. 7A is a perspective view showing a modification of fins of the upper guide plate, according to the third embodiment.
Figure 7B:
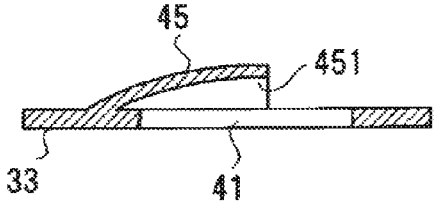
FIG. 7B is a cross-sectional view showing the modification of the fins the upper guide plate.
Figure 7C:
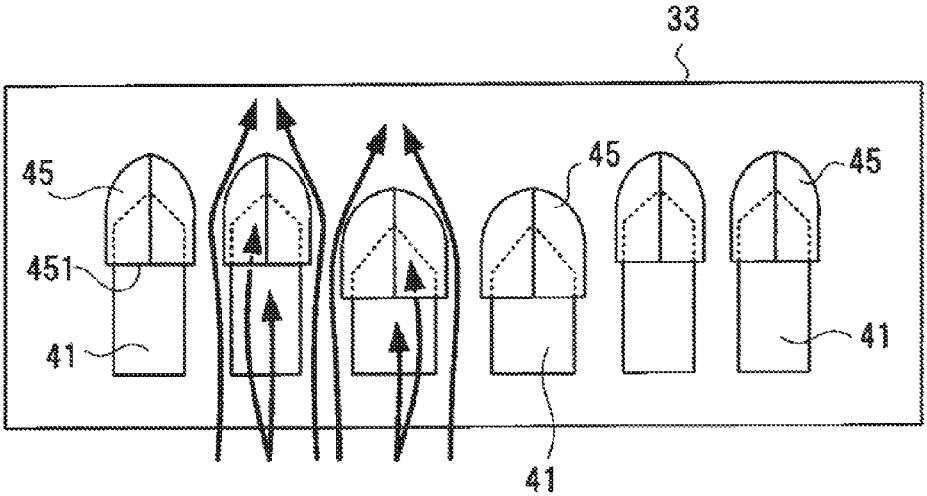
FIG. 7C is a plan view showing the modification of the fins of the upper guide plate.

A shape of the fin 44 is not limited to the shape shown in FIGS. 6A to 6C and may be modified to a shape shown in FIG. 7A to FIG. 7C.

FIG. 7A is a perspective view showing fins 45 mounted on upper portions of slits 41 of the upper guide 33 in an enlarged manner. FIG. 7B is a cross-sectional view of the fin 45 taken along the longitudinal direction of the slit 41, and FIG. 7C is a plan view of the upper guide 33 having the fins 45 as viewed from above.

The fin 45 has an inlet 451 (having an inverse V shape in cross section) which introduces air from the fan 31 to the slit 41, and has a streamline shape where a height and a width of the fin 45 is gradually decreased in the conveyance direction of a sheet S from the inlet 451. A height of the inlet 451 of the fin 45 is set smaller than a length of one blade 311 of the fan 31.

As indicated by bold lines in FIG. 7A and FIG. 7C, by forming the fins 45 on the upper portions of the slits 41 respectively, air which flows in the direction toward a downstream side from the fan 31 is divided into air which directly flows into the slits 41, air which flows into the slits 41 from the inlets 451 of the fins 45, and air which flows on an upper surface of the upper guide 33 in the direction toward a downstream side while routing around roofs of the fins 41.

Accordingly, air from the fan 31 may be efficiently made to flow into the conveyance path 143 thus cooling the sheet S. As described above, by setting a height of the fin 45 lower than a length of the blade 311 of the fan, air which does not flow into the conveyance path 143 may be made to flow along the upper surface of the upper guide 33. Thus, the upper guide 33 may be cooled.

Further, by forming the fin 45 into a shape where a width of the fin 45 is gradually narrowed toward a downstream side in the conveyance direction of the sheet S, noises generated when air hits the fins 45 may be reduced, thus making the erasing device quiet.

According to the above-mentioned embodiments, the sheet S may be efficiently cooled, heat is not accumulated in the conveyance path 143 for the sheet S. Accordingly, influence of heat on the reading unit 13 is avoided, thus preventing the lowering of the quality of a scanned image. Further, the upper guide 33 itself and the lower guide 34 itself may be cooled. Accordingly, when a person touches the inside of the erasing device 10 during a maintenance operation or the like, it is possible to prevent the person from having a burn or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A device for erasing an image on a sheet comprising:

a reading unit configured to read an image formed on the sheet;

an erasing unit configured to erase the image formed on the sheet by heating the sheet;

a conveyance path for conveying the sheet between the reading unit and the erasing unit, the conveyance path including guide plates arranged in an opposed manner, wherein one of the guide plates has at least one slit;

a cooling unit configured to cool the sheet which passes through the conveyance path, the cooling unit including at least one fan that supplies cooling air generally along a sheet conveying direction; and at least one introduction wall extending from one of the guide plates and configured to guide cooling air from the at least one fan through the at least one slit and into the conveyance path.

2. The device according to claim 1, wherein one of the guide plates has a first slit and a second slit.

3. The device according to claim 2, wherein the at least one introduction wall includes a first portion that extends from an outer edge of the first slit.

4. The device according to claim 3, wherein the at least one introduction wall further includes a second portion that connects an outer edge and an inner edge of the second slit.

5. The device according to claim 2, wherein the first slit is positioned outside of the second slit with respect to a center of the conveyance path in a direction orthogonal to the sheet conveying direction, and a length of the first slit is greater than a length of the second slit or a width of the first slit is less than a width of the second slit.

6. The device according to claim 2, wherein the first slit extends downstream in the sheet conveying direction and a length of the second slit is less than a length of the first slit.

7. The device according to claim 2, wherein the width of the second slit is greater than the width of the first slit in a direction orthogonal to the sheet conveying direction.

8. A method for cooling a sheet comprising the steps of:

conveying the sheet along a conveyance path between a first unit and a second unit, the conveyance path including guide plates arranged in an opposed manner and through which the sheet is conveyed, wherein at least one slit is formed in one of the guide plates, and at least one introduction wall extends from the at least one slit; and cooling, with a cooling unit, the sheet which passes through the conveyance path, wherein the cooling air from the cooling unit is guided by the at least one introduction wall to flow through the at least one slit into the conveyance path.

9. The method according to claim 8, wherein one of the guide plates has a first slit and a second slit.

10. The method according to claim 9, wherein the at least one introduction wall includes a first portion that extends from an outer edge of the first slit.

11. The method according to claim 10, wherein the at least one introduction wall further includes a second portion that connects an outer edge and an inner edge of the first slit.

12. The method according to claim 9, wherein the first slit is positioned outside of the second slit with respect to a center of the conveyance path in a direction orthogonal to the sheet conveying direction, and a length of the first slit is greater than a length of the second slit or a width of the first slit is less than a width of the second slit.

13. The method according to claim 9, wherein the first slit extends downstream in the sheet conveying direction and a length of the second slit is less than a length of the first slit.

14. The method according to claim 9, wherein the width of the second slit is greater than the width of the first slit in a direction orthogonal to the sheet conveying direction.

15. A device for cooling a sheet comprising:

a conveyance path for conveying the sheet between a first unit and a second unit, the conveyance path including guide plates arranged in an opposed manner and through which the sheet is conveyed, wherein one of the guide plates has at least one slit;

a cooling unit configured to cool the sheet which passes through the conveyance path, the cooling unit including at least one fan that supplies cooling air generally along a sheet conveying direction; and at least one introduction wall extending from one of the guide plates and configured to guide cooling air from the at least one fan through the at least one slit and into the conveyance path.

16. The device according to claim 15, wherein one of the guide plates has a first slit and a second slit formed in one of the guide plates.

17. The device according to claim 16, wherein the at least one introduction wall includes a first portion that extends from an outer edge of the first slit, and a second portion that connects an outer edge and an inner edge of the second slit.

18. The device according to claim 15, wherein the first slit is positioned outside of the second slit with respect to a center of the conveyance path in a direction orthogonal to the sheet conveying direction, and a length of the first slit is greater than a length of the second slit or a width of the first slit is less than a width of the second slit.

19. The device according to claim 15, wherein the first slit extends downstream in the sheet conveying direction and a length of the second slit is less than a length of the first slit.

20. The device according to claim 15, wherein the width of the second slit is greater than the width of the first slit in a direction orthogonal to the sheet conveying direction.

* * * * *